US005958280A

United States Patent [19]

Reichelt et al.

[11] Patent Number: 5,958,280

[45] Date of Patent: Sep. 28, 1999

[54] IMMERSION NOZZLE FOR POURING MOLTEN METAL (JOINT POINT)

[75] Inventors: Wolfgang Reichelt; Ulrich Urlau, both of Moers; Horst Maier; Klaus Franken, both of Aachen; Martin Wiesel, Wiesbaden; Karl-Heinz Schmitt, Dichtelbach, all of Germany

[73] Assignee: Mannesmann Aktiengesellschaft, Düsseldorf, Germany

[21] Appl. No.: 08/925,624

[22] Filed: Sep. 9, 1997

Related U.S. Application Data

[63] Continuation of application No. 08/901,911, Jul. 29, 1997, abandoned.

[30] Foreign Application Priority Data

Jul. 29, 1996 [DE] Germany ..... 196 31 566

[51] Int. Cl.[6] ..... B22D 35/00

[52] U.S. Cl. ..... 222/606; 222/591

[58] Field of Search ..... 222/594, 606, 222/607, 591

[56] References Cited

U.S. PATENT DOCUMENTS 5,314,099 5/1994 Butz et al. ..... 222/606
5,429,283 7/1995 Luhrsen et al. ..... 222/606

*Primary Examiner*—Scott Kastler
*Attorney, Agent, or Firm*—Cohen, Pontani, Lieberman & Pavane

[57] ABSTRACT

An immersion nozzle for pouring molten metal, especially steel, from a pouring vessel into a mold of a continuous casting machine. The nozzle includes a substantially tubular upper part that can be attached to the pouring vessel and a lower part that has a broad side significantly larger than its narrow side at the opening end. The upper part has, at the end facing the lower part, a flared section that encircles the entry area of the lower part. A seal is provided between the upper part and the entry area of the lower part. The lower part has a support in the entry area. Holding elements are provided so as to touch the support of the lower part and connect the lower part to the upper part.

25 Claims, 5 Drawing Sheets

Fig.1
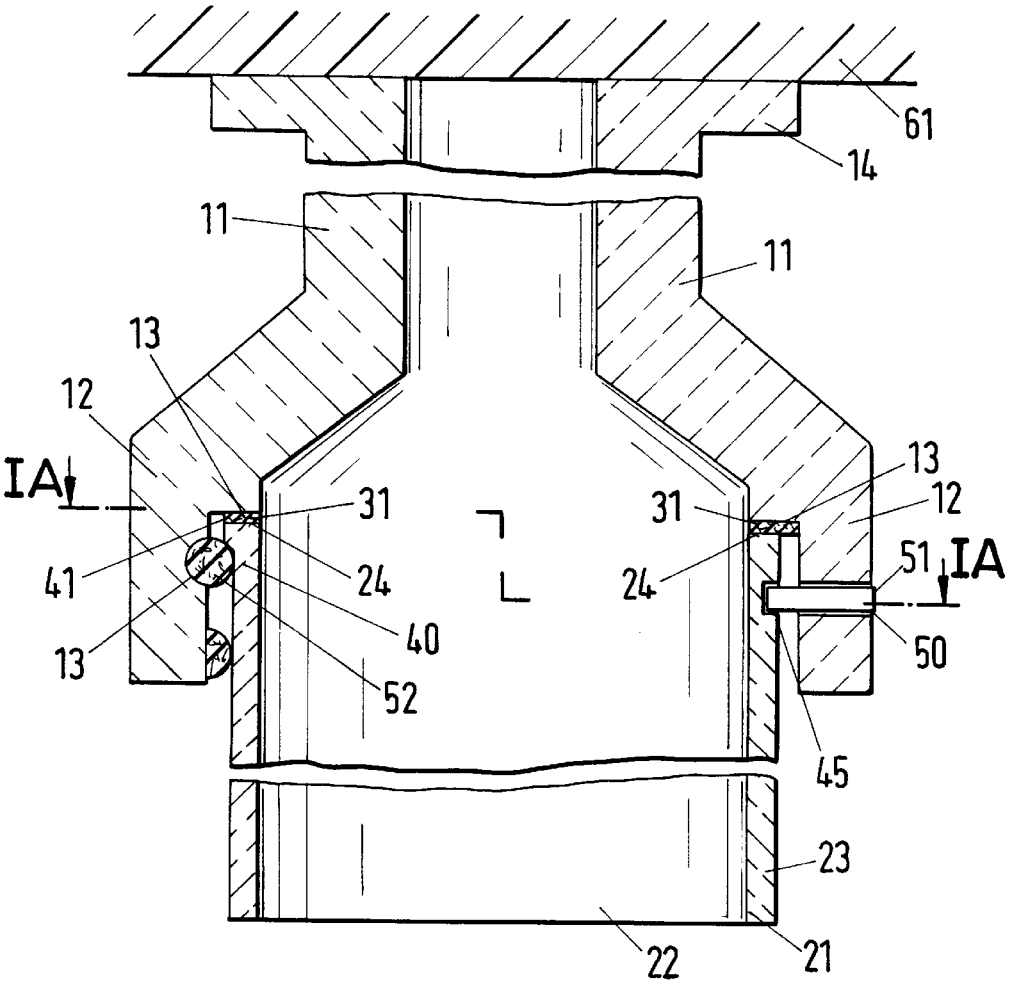
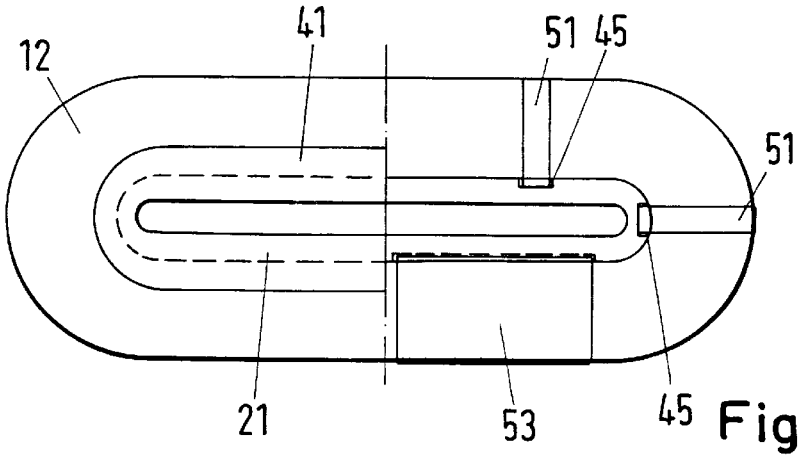
Fig.1A

Fig. 2
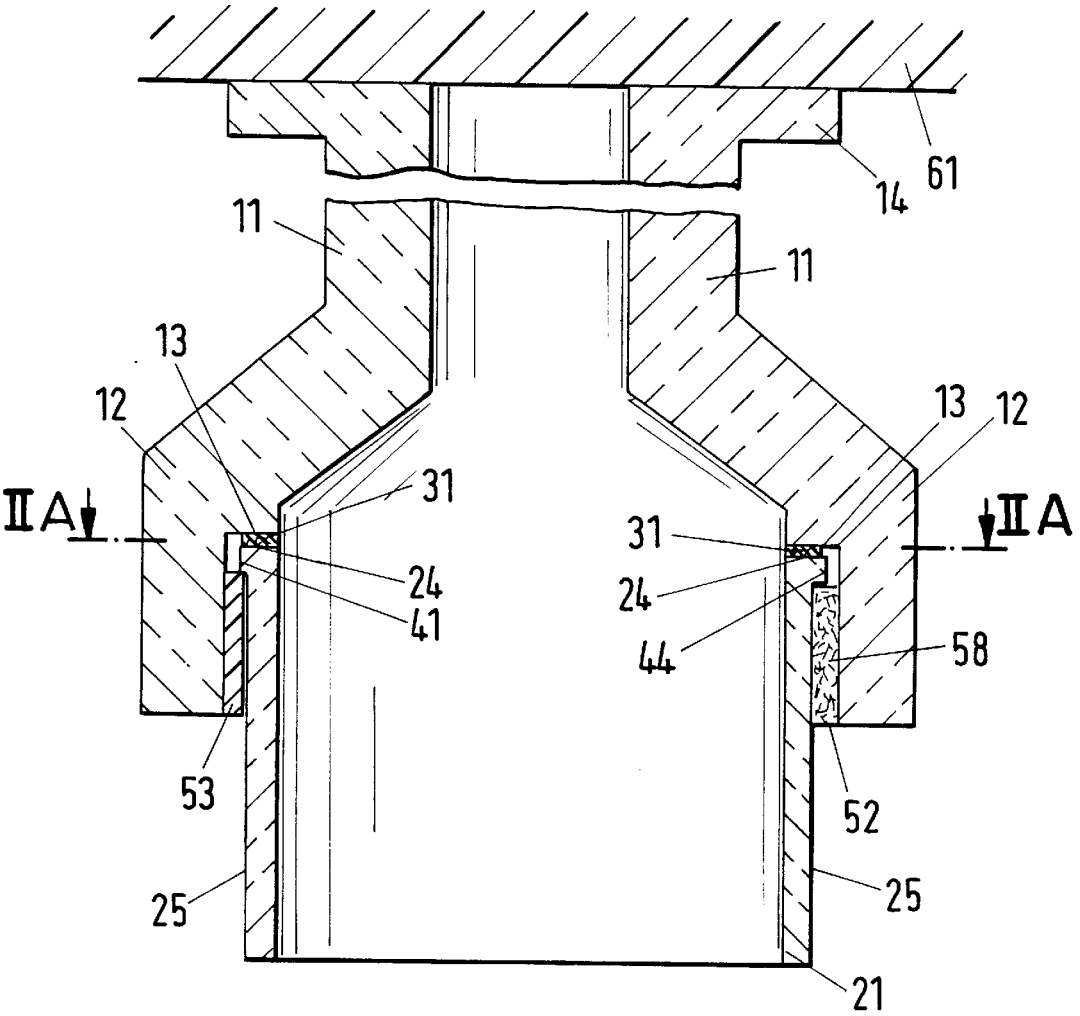
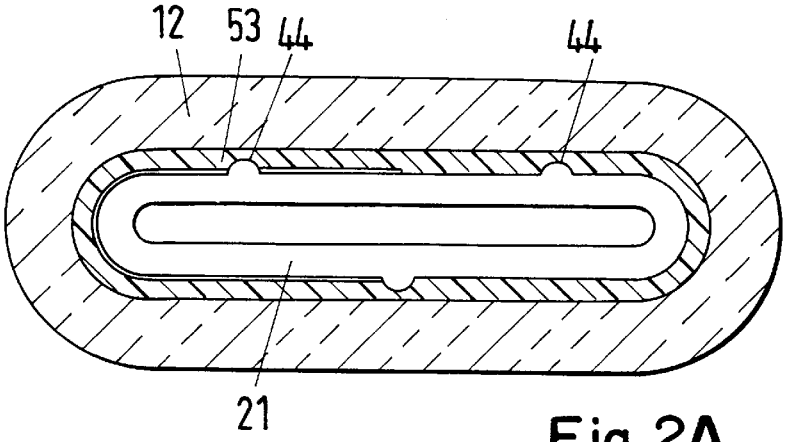
Fig. 2A

IMMERSION NOZZLE FOR POURING MOLTEN METAL (JOINT POINT)

This application is a Continuation of U.S. patent application Ser. No. 08/901,911 filed on Jul. 29, 1997 under 37 C.F.R. § 1.53 now abandoned.

BACKGROUND OF THE INVENTION

1. Field of the Invention

The invention relates to an immersion nozzle for pouring molten metal, especially steel, from a pouring vessel into a mold of a continuous casting machine. The immersion nozzle has a substantially tubular upper part, which can be attached to the pouring vessel, and a lower part that has a broad side significantly larger than its narrow side on the opening end. In the transitional zone, the interior walls of the upper part and the lower part correspond.

2. Description of the Prior Art

In multi-part immersion nozzles, especially those in which different nozzle parts are made of different refractory-grade materials, the joint point represents a particular weak spot.

German reference DE 41 42 447 teaches an immersion pouring tube for molten steel which at its separation joint in the tube flange, has a recess into which a seal can be placed for the purpose of sealing. The immersion tube itself is flanged to the bottom plate of the casting vessel.

Disadvantageously, the connection to the casting vessel influences the joint point of the immersion pouring tube part, which otherwise is only slightly different in material.

From German reference DE-OS 37 09 188, a pouring tube for metallurgical vessels is known, which has an inlet tube with a slot into which a first holding plate is laterally inserted. A second holding plate engages below a flange of the pouring tube connected downstream in the pouring direction. The second holding plate presses the pouring tube or the flange against the end of the inlet tube by means of pairs of threaded screws.

The refractory-grade components of this immersion nozzle are complicated in form. Furthermore, the joint point is formed by materials (i.e., the metal holding screws and the spherical ends of the pouring tube parts) that differ greatly with respect to thermal expansion.

German reference DE 43 20 723 discloses an immersion nozzle in which shaped bricks engage into one another. A seal is provided between the interengaged ends of the shaped bricks. The seal is meant to prevent exterior air from penetrating between the interengaged ends of the shaped bricks and making its way into the interior space of the immersion nozzle. The seal is also meant to absorb differing thermal expansions of the shaped bricks. On the part of the immersion nozzle that faces the mold, there is a holding mechanism that is fastened underneath by elbows, so that the total of three shaped bricks of the immersion nozzle are held securely together during operation. At the other end, the holding mechanism is attached to a component that is independent of the immersion nozzle, with the disadvantage that here uncontrolled movements of individual parts of the immersion nozzle can occur.

SUMMARY OF THE INVENTION

The object of the present invention is to provide an immersion nozzle for pouring molten metal, in which the stresses are limited at the seam point between the nozzle parts made of different refractory-grade materials and, at the same time, a gas-tight connection of the two parts is ensured.

Pursuant to this object, and others which will become apparent hereafter, one aspect of the present invention resides in an immersion nozzle having a substantially tubular upper part attachable to the pouring vessel, and a lower part that has an opening end with a narrow side and a broad side significantly larger than the narrow side, the upper part having an end facing the lower part and a flared section at the end configured to encircle an inlet area of the lower part. A seal is provided between the upper part and the inlet area of the lower part. The lower part has a support in the inlet area. Holding elements are arranged to touch the support of the lower part and are configured to connect the lower part to the upper part.

According to the invention, the lower part of the nozzle, which is made of highly corrosion-resistant refractory-grade material, is provided with a support. The support is embodied as an outward projection or as a recess. Holding elements engage below the projection or into the recess and connect the lower part to the flared section of the encircling upper part.

When the support is designed as a projection, the projection can have enlarged faces at the entry for the lower part. In another embodiment of the invention, the projection is separated from the face of the lower part to such an extent as to protrude out of the opening of the flared section of the upper part. In this case, springs designed as clamps or clips engage below the projection and above the flared section, and thus connect the lower part to the upper part in a force-locking manner.

In a further embodiment, the projection is embodied in the form of points distributed at three or more locations on the circumference of the lower part.

Elastic elements that provide permanent and controlled bracing are provided between the flared section of the upper part and the entry area of the lower part. This bracing prevents uncontrolled movements of the individual parts of the immersion nozzle.

The desired elastic adjustment can be attained by independent elements or by suitable construction of the seal and/or holding elements. The holding elements are embodied, with respect to form and material, in a manner adjusted to the loads.

In a first embodiment, the holding elements are provided with zones that have a reduced modulus of elasticity. This modulus of elasticity is 3 to 10 times smaller than the smallest E-modulus of the two partner materials. The zones with a reduced modulus of elasticity are created by cavities left in them or by inserts, especially fibers, that are introduced.

In another embodiment, the refractory-grade holding elements, with respect to shape, are bodies that narrow conically and have, at the narrowing end, a contact surface with a size that can exceed the contact point strength starting at a predeterminable local stress. This shape can also be formed by means of two elements of conical bodies that run together.

In a further embodiment, the holding element is designed as a supporting ring or a flange. The holding element is attached to the upper part and, at its other end, rests on the projection or in the recess of the lower part. Attachment is carried out by adhesion, pins or screws.

Fibers compressed between the upper and lower parts serve as the sealing material. In still another embodiment, materials that become viscous are also used; here, in particular, glass, glass solder or frit, i.e., a glassy powder. At the high temperatures prevailing during operation, these form an absolutely sealing plastic mass. It is also proposed to design the sealing surfaces that contact the seal as a labyrinth, here as a slot and springs.

In another embodiment, thin-walled connecting parts are provided between the upper and lower parts. In their longitudinal extension, these connecting parts are able to absorb tensile and pressure forces. The connecting parts are adequately deformable in the thickness direction and are thus able to absorb the different thermal expansions of the lower or upper part in a stress-limited fashion. Elastic sealing material is provided between the thin-surfaced connecting parts, permitting the free movement of components when a gas-tight seal exists.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

FIG. 1 is a section of an immersion nozzle pursuant to the present invention with a projection and a recess as the support;

FIG. 1A is a section along the IA—IA in FIG. 1;

FIG. 2 is a view similar to FIG. 1, with projections and holding elements having a reduced modulus of elasticity;

FIG. 2A is a section along the line IIA—IIA in FIG. 2;

DETAILED DESCRIPTION OF THE PREFERRED EMBODIMENTS

Figure 3:
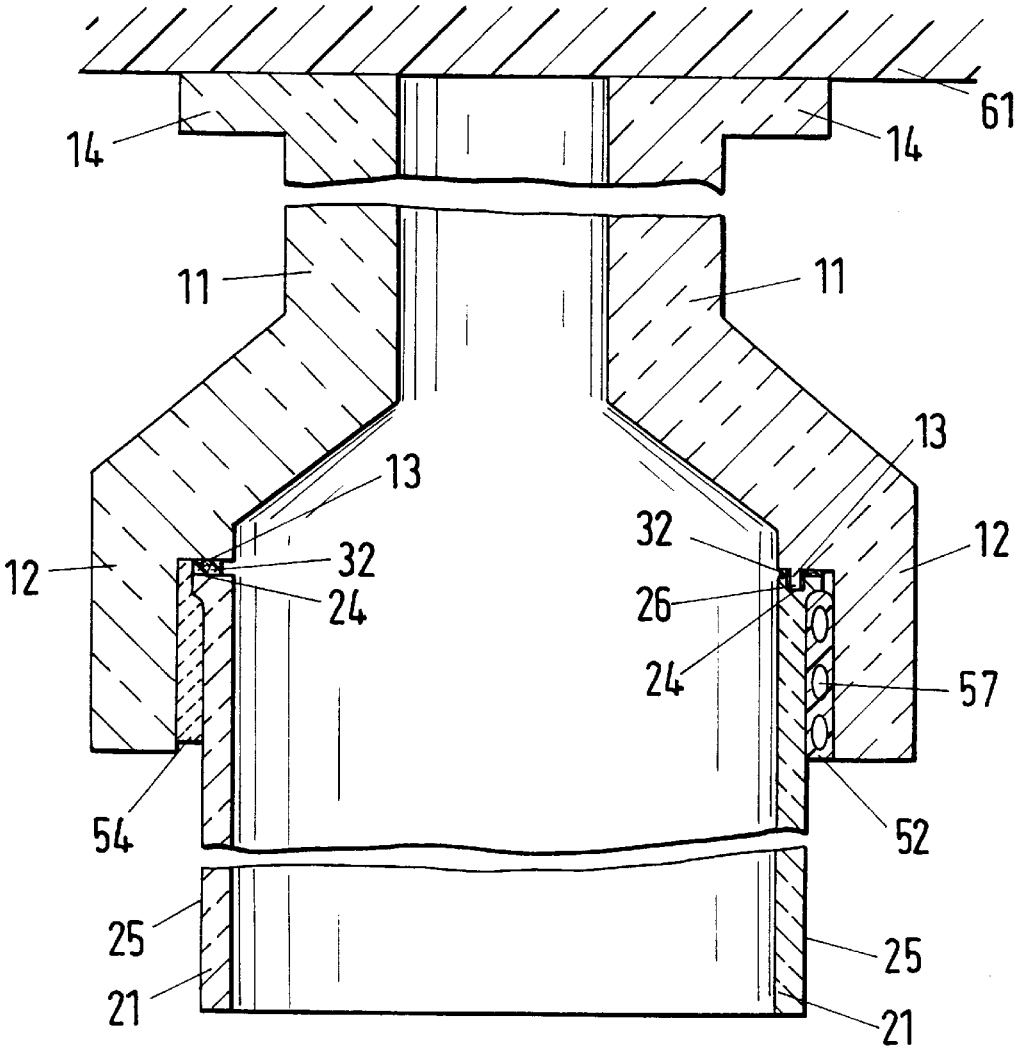
FIG. 3 is a view similar to FIG. 1 with projections and holding elements as ceramic bodies and with cavities.

All of the drawings show an immersion nozzle having a tubular upper part 11 that is attached to a pouring vessel 61 via an attachment flange 14. The upper part 11 has a flared section 12 that encircles a lower part 21, which has a broad side 22 and a narrow side 23.

In FIG. 1, a sealing material 31 is provided between a face 13 of the upper part 11 and a face 24 of the lower part 21.

On the left side in FIG. 1, a support 40 for the upper part 11 includes a projection 41 that is provided in the area of the face 24 that rests on a supporting ring 52. The interior wall of the flared section 12 is flat-surfaced and a lower supporting ring 52*a* attaches thereto, particularly by adhesion. An upper supporting ring 52 is held in a positive-locking manner by a slot 15 provided in the flared section 12.

On the right side of FIG. 1, the support is embodied as a recess 45, into which a holding element 50, such as a pin 51, extends. The pin 51 runs through the flared section 12 of the upper part 11.

The lower part of the drawing shows Section IA—IA. The left part of the Section shows the encircling projection 41 arranged on the lower part 21. The right part of the drawing shows holding elements in the form of pins 51 and plates 53.

FIG. 2 shows a support in the form of the projection 41, which is designed as the catch 44. FIG. 2A shows a total of three catches 44. The upper left of FIG. 2 shows a plate 53, which is attached to the interior side of the flared section 12 and is located at a distance from the outer wall 25 of the lower part 21. The right side of FIG. 2 shows a supporting ring 52 that is composed of fibers 58. The sealing material 31 is introduced between the face 13 of the upper part 11 and the face 24 of the lower part 21.

The left side of FIG. 3 shows ceramic bodies 54, which rest either on the outer wall 25 of the lower part 21 and the interior surface of the flared section 12 or directly on the projection 41.

The right side of FIG. 3 shows a supporting ring 52, which has zones 57 that reduce the modulus of elasticity of the holding elements.

Furthermore, on the right side of FIG. 3, the face 24 is embodied with a slot and the face 13 with a spring formed as a labyrinth 26. A viscous seal 32, e.g., glass, especially in the form of powder (frit), is placed into the intermediate spaces shown on the left and right sides of FIG. 3.

Figure 4:
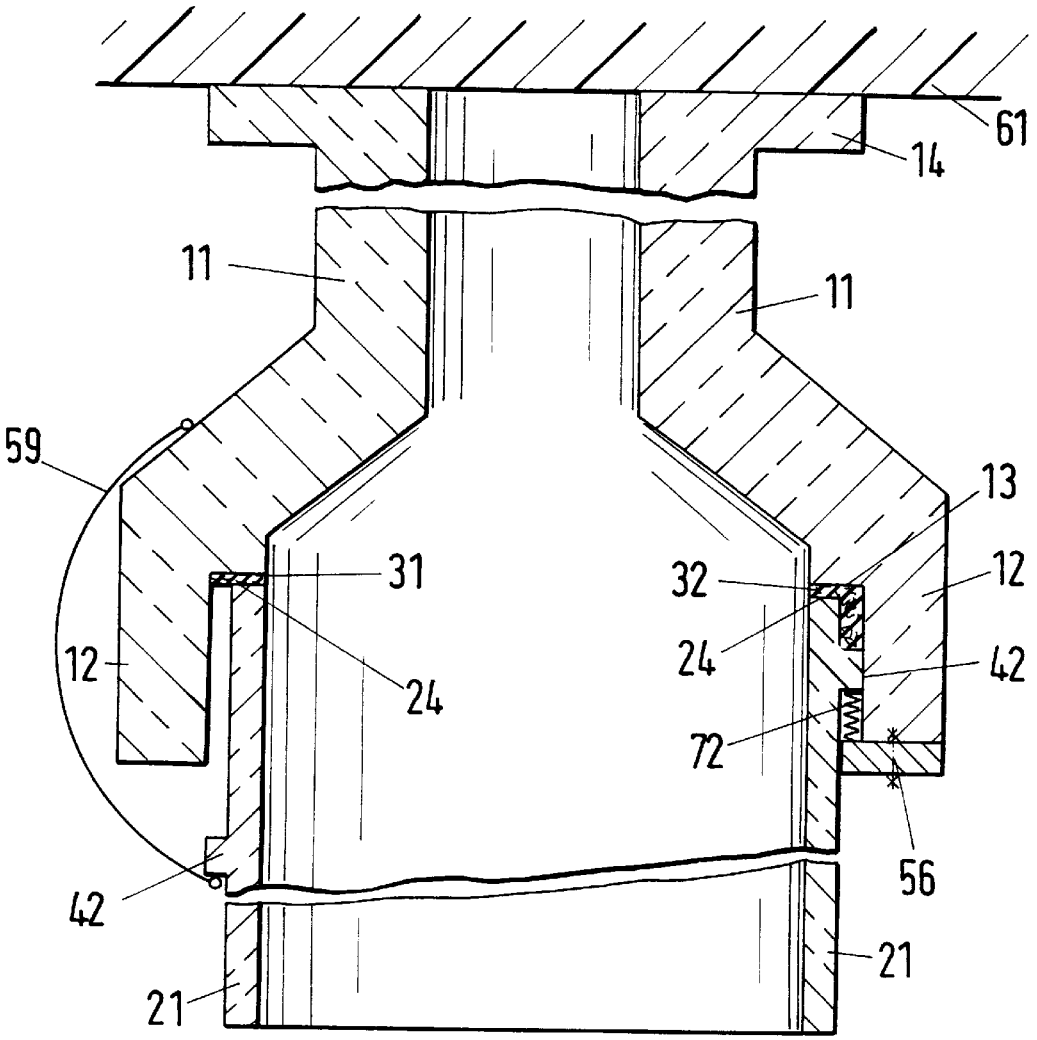
FIG. 4 is a view similar to FIG. 1, with projections located at a distance from the face.

FIG. 4 shows a projection 42, which is located at a distance from the face 24 of the lower part 21. On the left side, a clip or brace 59 engages below the projection 42 and above the flared section 12 and thus compresses the seal 31 located between the lower part 21 and the upper part 11. On the right side, a flange 56, which corresponds to the projection 42 of the lower part 21, is provided on the opening of the flared section 12. FIG. 4 also shows a bracing spring 72, which is located between the flange 56 and the projection 42 at a distance from the face. In addition, a viscous seal 32 is placed between the flared section 12 of the upper part and the lower part 21.

Figure 5:
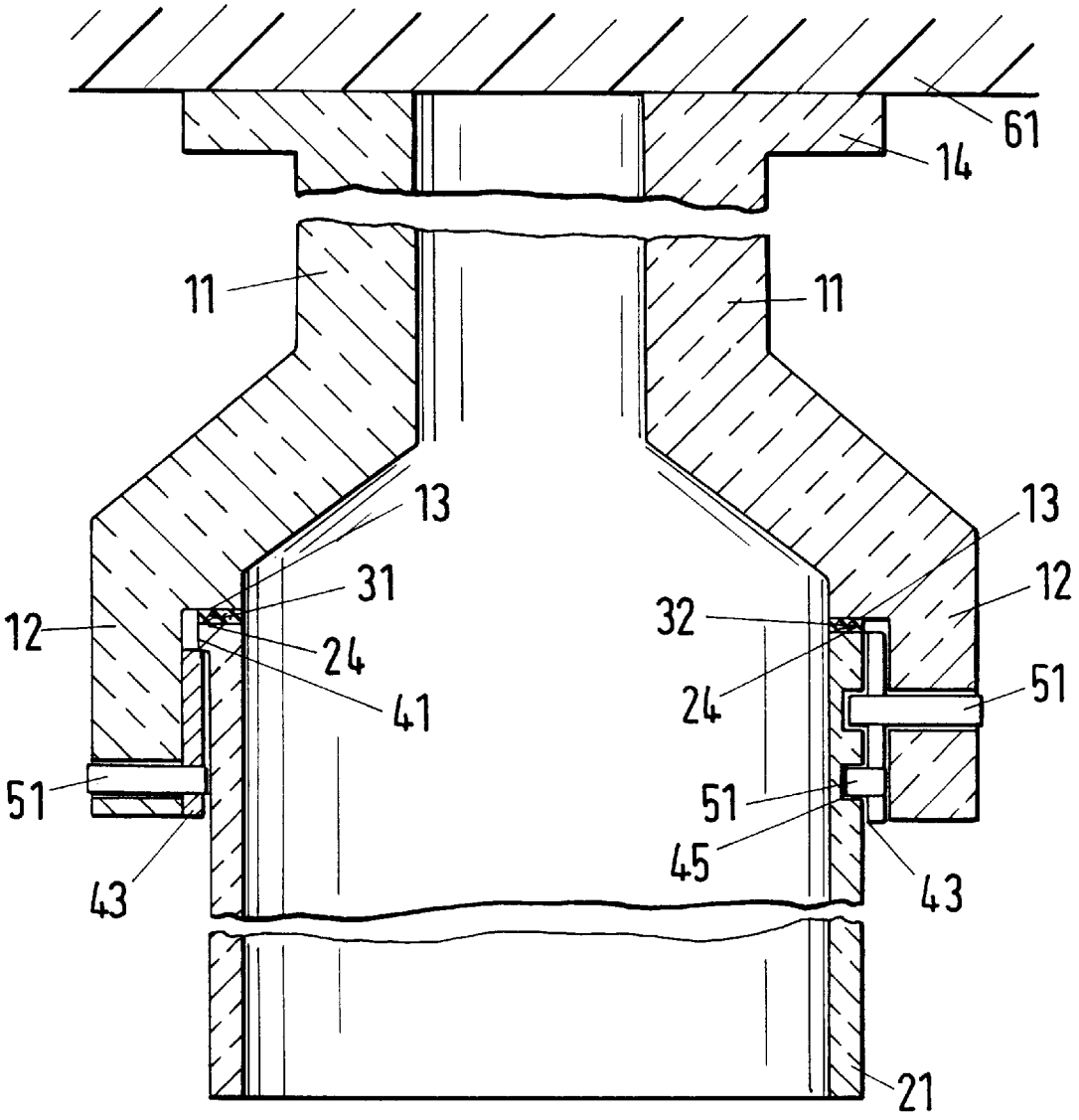
FIG. 5 is a view similar to FIG. 1, with thin-surfaced connecting parts.

In FIG. 5, the upper part 11 is connected to the lower part 21 via connecting parts 43. On the left side, the thin-walled connecting part 43 is held by a pin 51, which runs through the flared section 12. At the other end, the connecting part 43 rests on the projection 41. The sealing material 31 is located between the faces 13, 24.

On the right side, the thin-walled connecting part 43 is held at one end by a pin 51 that is located in the recess 45 in the lower part 21 and at the other end by a pin 51 that runs through the flared section 12. Viscous sealing material 32 can be introduced into the empty spaces between the lower part 21 and the flared section 12.

The invention is not limited by the embodiments described above which are presented as examples only but can be modified in various ways within the scope of protection defined by the appended patent claims.

We claim:

1. An immersion nozzle for pouring molten metal from a pouring vessel into a mold of a continuous casting machine, comprising:

a substantially tubular upper part attachable to the pouring vessel;

a lower part that has an opening end with a narrow side and a broad side significantly larger than the narrow side, the upper part having an end facing the lower part and a flared section at the end configured to encircle an inlet area of the lower part;

a seal provided between the upper part and the inlet area of the lower part, the lower part having a support in the inlet area, the support being configured as recesses in an outer wall of the lower part; and holding elements arranged to touch the support of the lower part and configured to connect the lower part to the upper part.

2. An immersion nozzle for pouring molten metal from a pouring vessel into a mold of a continuous casting machine, comprising:

a substantially tubular upper part attachable to the pouring vessel;

a lower part that has an opening end with a narrow side and a broad side significantly larger than the narrow side, the upper part having an end facing the lower and a flared section at the end configured to encircle an inlet area of the lower part;

a seal provided between the upper part and the inlet area of the lower part, the lower part having a support in the inlet area; and elastic holding elements arranged between the flared section of the upper part and the inlet area of the lower part so as to touch the support of the lower part, and configured so as to permanently brace the upper part and the lower part relative to one another in an adjustable manner.

3. An immersion nozzle as defined in claim 1, wherein the support is an outwardly-directed projection formed on the lower part.

4. An immersion nozzle as defined in claim 3, wherein the projection is formed in the inlet area of the lower part so as to provide enlarged end faces.

5. An immersion nozzle as defined in claim 3, wherein at least three punctiform projections are provided in the inlet area of the lower part.

6. An immersion nozzle as defined in claim 2, wherein the holding elements are formed of refractory-grade material that has zones with a reduced modulus of elasticity.

7. An immersion nozzle as defined in claim 6, wherein the zones with a reduced modulus of elasticity are formed by cavities in the holding element material.

8. An immersion nozzle as defined in claim 6, wherein the zones with a reduced modulus of elasticity are formed by inserts.

9. An immersion nozzle as defined in claim 8, wherein the inserts are fibers.

10. An immersion nozzle as defined in claim 6, wherein the holding elements are springs.

11. An immersion nozzle as defined in claim 10, wherein the springs are leaf springs of heat-resistant metal.

12. An immersion nozzle as defined in claim 6, wherein at least three individual holding elements are provided so as to be substantially uniformly distributed over the circumference of the lower part.

13. An immersion nozzle as defined in claim 12, wherein the holding elements are formed as conically narrowing bodies that, at a narrowed end, have a contact surface that exceeds, starting from a predeterminable local stress, a contact point strength.

14. An immersion nozzle as defined in claim 2, wherein the holding elements are formed as a support ring attached to the flared section of the upper part.

15. An immersion nozzle as defined in claim 3, wherein the holding elements are formed as a flange attached to an end face of the flared section of the upper part and on which a lower side of the projection of the lower part rests.

16. An immersion nozzle as defined in the claim 15, and further comprising a bracing spring provided between the flange and the projection.

17. An immersion nozzle as defined in claim 1, and further comprising means for attaching the holding elements to at least one of the upper part and the lower part.

18. An immersion nozzle as defined in claim 17, wherein the attaching means includes an adhesive.

19. An immersion nozzle as defined in claim 17, wherein the attaching means includes at least one of pins and screws.

20. An immersion nozzle as defined in claim 3, wherein the projection is provided at a distance from an inlet end face of the lower part so as to be located outside of an opening of the flared section of the upper part.

21. An immersion nozzle as defined in claim 20, wherein the holding elements include a brace configured to extend below the projection of the lower part and above the flared section of the upper part.

22. An immersion nozzle as defined in claim 1, wherein the seal is formed of one of glass, glass solder and frit.

23. An immersion nozzle as defined in claim 1, wherein the upper part and the lower part have sealing surfaces in contact with the seal, the sealing surfaces having a labyrinthian configuration.

24. An immersion nozzle as defined in claim 1, and further comprising:

thin-surfaced connecting parts provided between the support of the lower part and the opening of the flared section of the upper part.

25. An immersion nozzle as defined in claim 24, wherein the seal includes an elastic sealing material arranged between the thin-surfaced connecting parts.

* * * * *